United States Patent [19]

Wade

[11] Patent Number: 4,750,700

[45] Date of Patent: Jun. 14, 1988

[54] APPARATUS USED TO HANG ARTICLES ON BOARDS

[76] Inventor: Earl R. Wade, 14912 E. Truman Rd., Independence, Mo. 64050

[21] Appl. No.: 20,114

[22] Filed: Feb. 26, 1987

[51] Int. Cl.[4] ..... A47F 5/00

[52] U.S. Cl. ..... 248/221.2; 248/303; 211/59.1

[58] Field of Search ..... 248/221.2, 220.4, 220.3, 248/221.1, 303, 222.7; 211/54.1, 59.1, 57.1

[56] References Cited

U.S. PATENT DOCUMENTS

| | | | |
|---|---|---|---|
| 2,544,516 | 3/1951 | Walters | 248/303 X |
| 3,094,892 | 6/1963 | Topf | 248/220.3 X |
| 3,145,963 | 8/1964 | Best et al. | 248/220.3 |
| 3,260,489 | 7/1966 | Hentzi | 248/303 X |
| 3,289,992 | 12/1966 | Brooks | 248/220.3 |
| 3,972,499 | 8/1976 | Simmons | 248/221.2 X |
| 4,029,281 | 6/1977 | Marshall | 248/220.3 |
| 4,422,608 | 12/1983 | Hogg | 248/222.2 X |

FOREIGN PATENT DOCUMENTS

| | | | |
|---|---|---|---|
| 1084577 | 7/1954 | France | 248/220.3 |
| 1130001 | 10/1968 | United Kingdom | 248/222.2 |

*Primary Examiner*—Alvin C. Chin-Shue

*Attorney, Agent, or Firm*—Litman, McMahon & Brown

[57] ABSTRACT

A hook apparatus used for hanging articles on pegboards which includes a length of plated, resilient wire bent at various points and at various angles to create a hook which requires only a single hole for tight engagement. Due to the geometrical configuration of the sections relative to the board surface and to the pegboard hole, pressing the hook into position in a single hole in a pegboard generates a spring force in the hook which is opposed by the pegboard surface and hole edges, and which holds the hook tightly in position. Although engagement in only one hole is necessary for tight engagement, the hook apparatus is of such a configuration that the hook may be engaged in an upper pegboard hole for maximum tightness, with a stabilizer bend portion engaging a next lower hole to resist side-to-side deflection.

1 Claim, 1 Drawing Sheet

APPARATUS USED TO HANG ARTICLES ON BOARDS

BACKGROUND OF THE INVENTION

1. Field of the Invention

The present invention relates generally to an apparatus positioned in holes in pegboards on which articles may be hung.

2. Description of the Prior Art

The conventional apparatus used for hanging articles on a pegboard consists of a length of resilient wire with a hook at each end, oriented in opposing directions. A small stub for stabilization is tack welded on the vertical length of the hook at its lowest point. The stub must be welded on the hook at such a position that when the hook is inserted in a pegboard hole and the vertical segment is allowed to lie flat against the surface of the pegboard, the stub will be inserted in the next, lower available hole. However, a recurrent problem with this configuration is that a slight upward bump or jar to the hook will often cause the hook to dislodge and drop the article hung on the hook to the floor.

SUMMARY OF THE INVENTION

The present invention provides an apparatus for hanging articles on pegboards and is made from a single piece of metallic, resilient wire bent into a series of sections varying in length. A stub end is provided for the pegboard hole engagement. The stub end transmits torsional force imposed at the pegboard surface to the two points where the stub end engages opposite aperture edges. The intermediate section imposes the torsional force on the stub end through spring tension in the wire once it is pressed against any portion of the board's surface below the hole. The load carrier provides the section length on which the load will be supported and is connected to the intermediate section by a stabilizer bend. The stabilizer bend is that part of the hook which engages and biases against the board surface. The stabilizer bend can be positioned on the hook during manufacture so that it will engage the board surface at the next hole below and thereby resist side-to-side movement.

OBJECTS OF THE INVENTION

The principle objects of the present invention are: to provide an apparatus for hanging articles on a vertical surface which can be positioned into a single hole on said surface; to provide such an apparatus which can be manufactured by merely bending a length of resilient wire at particular angles between the individual sections; to provide an apparatus which can be manufactured without any welding and, therefore, one which can be manufactured from wire plated with a corrosion resistant material; to provide an apparatus which is efficient in operation, economical to manufacture, capable of a long operating life and particularly well adapted for its proposed usage.

Other objects of the invention will become apparent from the following description taken in conjunction with the accompanying drawing wherein are set forth, by way of illustration and example, certain embodiments of this invention.

The drawings constitute a part of this specification and include exemplary embodiments of the present invention and illustrate various objects and fixtures.

DESCRIPTION OF THE PREFERRED EMBODIMENT

Figure 1:
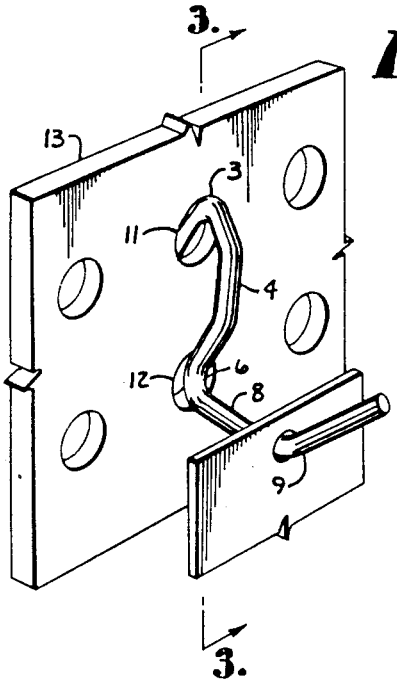
FIG. 1 is a perspective view of the hook apparatus mounted on a pegboard and supporting a load.
Figure 2:
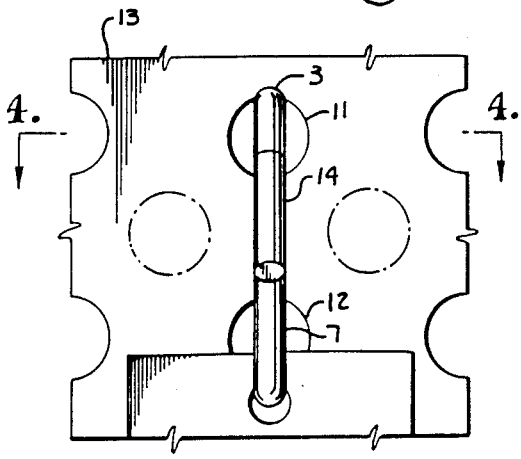
FIG. 2 is a front elevational view of the hook in the engaged position.

As required, detailed embodiments of the present invention are disclosed herein, however, it is to be understood that the disclosed embodiments are merely exemplary of the invention which may be embodied in various forms. Therefore, the specific structural and functional details disclosed herein are not to be interpreted as limiting, but merely as a basis for the claims and as a representative basis for teaching one skilled in the art to variously employ the present invention in virtually any appropriately detailed structure.

Referring more in detail to the drawings:

A hook 14 is generally formed with a stub end 15, an intermediate leg 4, a stabilizer bend 6, and a load carrying arm 7, and of a sturdy material such as No. 9 galvanized wire. The dimensions of the preferred embodiment will be indicated as those necessary for proper operation of the hook 14 with a standard pegboard 13, such as of a 0.250 diameter or 0.160 diameter hole.

Figure 3:
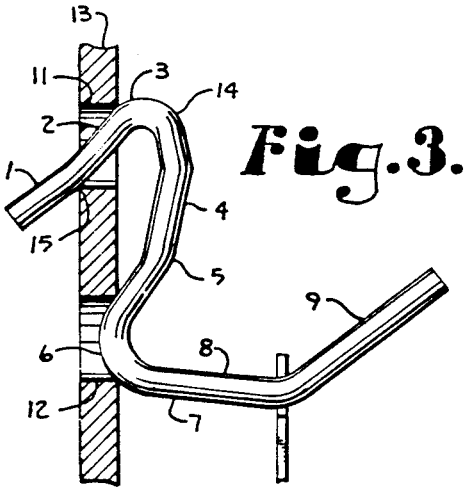
FIG. 3 is a side sectional view, taken along the line 3—3, in FIG. 1.
Figure 4:
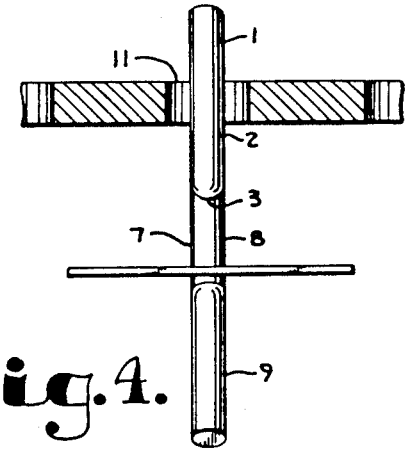
FIG. 4 is a sectional view, taken along the line 4—4, in FIG. 2.

In more detail, the stub end 15 is comprised of an insert section 1 and an angle section 2, FIG. 3. The insert section 1 of the stub end 15 is that portion which initially extends through the upper pegboard hole 11 for engagement with the pegboard 13. The stub end 15 is comprised of the two sections 1 and 2 which are connected by an acute bend, the purpose of which is to accentuate the process by which spring tension is imposed in the hook apparatus 14 upon engagement of the aperture edges in the pegboard hole 11. In a preferred embodiment, the length of the insert section 1 and the angle section 2 is 0.4 and 0.3 inches, respectively. The two stub end sections 1 and 2 are joined in to an acute bend of approximately 10 degrees.

The angle section 2 of the stub end 15 is connected to the intermediate leg 4 by an obtuse bend 3 having an optimal angle of about 30 degrees. As an example, the intermediate leg 4 is 0.63 inches long and is of a length necessary to allow the stub end 15 to engage an upper pegboard hole 11 while the stabilizer bend 6 engages the next lower hole 12 in the pegboard 13.

The stabilizer bend 6 is connected to the intermediate leg 4 through an angled juncture of approximately 22 degrees. The stabilizer bend 6 is, itself, created by a bend in the wire of 5/64 Rad., inside diameter. This allows the stabilizer bend 6 to be cradled by a standard pegboard hole 12. The stabilizer bend 6 is next joined to the load carrying arm 7, which, in the illustrated example, is formed of a carrier portion 8 and an upwardly angled tip 9. In a preferred embodiment, the load carrier portion 8 is 1.02 inches long and is connected to the angled tip 9 via a 45 degree angle, and the tip 9 is preferably 0.95 inches long.

Figure 6:
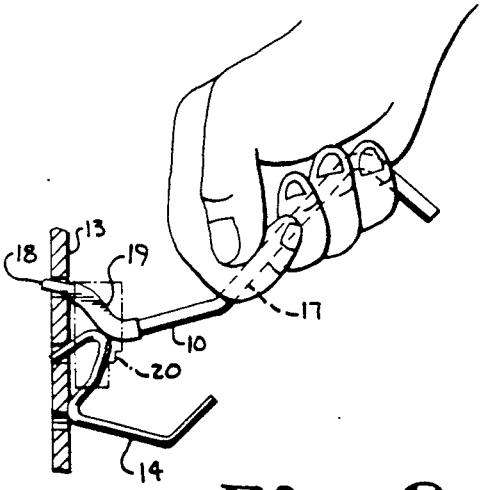
FIG. 6 illustrates a tool used for pressing the hook into position on the pegboard.
Figure 5:
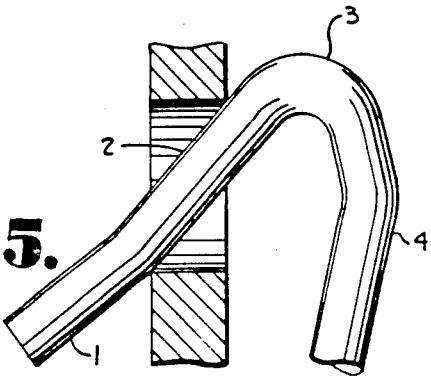
FIG. 5 is an enlarged, fragmentary side view of the pegboard hooks as it engages the pegboard hole.

The method by which the hook 14 is inserted into the pegboard hole 11 is described below. The insert section 1 of the stub end 15 is first inserted into a selected pegboard hole 11. Full engagement occurs when the stub end 15 is pressed into the pegboard hole 11 to such an extent that the stabilizing bend 6 is cradled in the next lower available hole 12. Full engagement can be achieved either by exerting downward force on the obtuse bend 3 connecting the stub end angle section 2 and the intermediate leg 4 or through the application of a hook mounting tool 10, FIG. 6. The hook mounting tool 10 is generally in the form of a lever arm with an outwardly extending handgrip portion 17, a tip end 18 insertable into a pegboard hole next above the hole into which the hook insert section 1 is received, and an enlarged contact portion 19 that engages and bears down upon the hook obtuse bend 3. Preferably, a shroud 20 extends over the contact portion 19 and the hook obtuse bend 3 and restrains the hook mounting tool 10 from slipping out of contact with the hook. Thus restrained, the hook mounting tool 10 is urged downward in a rotational path and forcing the hook obtuse bend 3 snugly into the hole. In this position, the hook 14 is in tight engagement with the pegboard 13 and ready to receive the desired loads.

While the invention has been particularly shown and described with reference to a preferred embodiment thereof, it will be understood by those skilled in the art that various changes in form and details may be made therein without departing from the spirit and scope of the invention.

What is claimed and desired to be secured by Letters Patent is as follows:

1. In combination, a pegboard and a hook for use with the pegboard and for insertion into a pegboard hole having a diameter and front and rear edges; said hook comprising:

(a) a downwardly extending stub end of slightly less diameter than the diameter of the pegboard hole and having a length to substantially extend through the hole when said hook is in an operative position thereof; said stub end having a bend intermediately positioned therealong to accentuate the imposition of tension between said hook and pegboard; said bend located near the hole rear edge when said hook is in the operative position thereof;

(b) an intermediate leg joining said stub end at a juncture and having a first acute angle therebetween when said hook is in a nonoperative position thereof; said intermediate leg extending generally downward along a front face of said pegboard when said hook is in the operative position thereof; said intermediate leg having a region of engagement therealong spaced from said juncture and engaging the peg board under spring tension when said hook is in the operative position thereof; said stub end being biased into engagement with diametrically opposed sides of the front edge and rear edge of said hole when said intermediate leg is biased against the peg board front face and when said hook is in the operative position thereof; said junction being spring biased to retain said first angle and to maintain a spring force biasing said intermediate leg snugly against said pegboard; when said hook is in the operative position thereof, said stub end and said intermediate leg are angled relative to one another greater than said first acute angle such that both said stud end and said intermediate leg are strongly biased against the pegboard at the hole and at said region of engagement; said intermediate leg being of sufficient length to bias against a front face of a second pegboard hole at said region of engagement beneath the hole wherein said stub end is inserted in the operative position thereof;

(c) said region of engagement comprising a stabilizer bend joining said intermediate leg at and obtuse angle, and said stabilizer bend is inserted in the second pegboard hole when said hook is in the operative position; and (d) a load carrier arm joining said stabilizer bend and extending angularly outwardly thereof.

* * * * *